US007588238B2

(12) United States Patent
Walther

(10) Patent No.: US 7,588,238 B2
(45) Date of Patent: Sep. 15, 2009

(54) METHOD AND DEVICE FOR GATHERING SHEETS

(75) Inventor: Andreas Walther, Stadthagen (DE)

(73) Assignee: Kolbus GmbH & Co. KG, Rahden (DE)

( * ) Notice: Subject to any disclaimer, the term of this patent is extended or adjusted under 35 U.S.C. 154(b) by 425 days.

(21) Appl. No.: 11/492,265

(22) Filed: Jul. 25, 2006

(65) Prior Publication Data

US 2007/0023998 A1 Feb. 1, 2007

(30) Foreign Application Priority Data

Jul. 28, 2005 (DE) ..... 10 2005 035 333

(51) Int. Cl.
*B65H 39/00* (2006.01)
*B65H 5/00* (2006.01)
*B65H 29/00* (2006.01)

(52) U.S. Cl. ..... 270/52.16; 270/52.14; 271/184; 271/225

(58) Field of Classification Search ..... 271/184, 271/225; 198/608, 419.2, 624, 461.2, 459.8; 270/52.01, 52.16, 52.14
See application file for complete search history.

(56) References Cited

U.S. PATENT DOCUMENTS 3,414,257 A 12/1968 Muller
3,658,322 A * 4/1972 Martin ..... 271/184
3,912,258 A * 10/1975 Martin ..... 271/184
4,201,377 A * 5/1980 Honegger ..... 271/225
4,842,125 A * 6/1989 Besemann ..... 198/457.03
5,374,052 A * 12/1994 Folsom ..... 271/225
5,415,385 A * 5/1995 Newsome et al. ..... 270/58.25
6,022,014 A * 2/2000 Rathert et al. ..... 271/11
6,406,014 B1 * 6/2002 Reist ..... 271/3.24
2005/0077670 A1 4/2005 Graushar et al.

FOREIGN PATENT DOCUMENTS

DE 33 15 489 A1 11/1983
DE 196 16 047 A1 10/1997

* cited by examiner

*Primary Examiner*—Patrick H Mackey
*Assistant Examiner*—Ernesto Suarez
(74) *Attorney, Agent, or Firm*—Alix, Yale & Ristas, LLP

(57) ABSTRACT

During the gathering process, an individual signature is respectively withdrawn from several collections of identical signatures, wherein the various decollated signatures are delivered to a collecting conveyor in order to form stacks. The invention proposes that the sheets (3) of a collection (4) are transported in a direction that is essentially oriented transverse to the transport direction (F) of the collecting container (10) in the form of continuous stream feed (4) of sheets (3) that lie on top of one another in a shingled fashion, that the respective front sheet (3) is taken hold of by a conveyor (42) on its leading section such that it is prevented from turning and displaced such that it is deflected in the transport direction (F) of the collecting conveyor (10), and that the displaced sheet (3) is received by a withdrawal conveyor system (50) and additionally transported in said transport direction (F) in order to synchronously deliver the sheets (3) to the collecting conveyor (10) in the corresponding cycle. This makes it possible to reliably and carefully process sheets supplied in the form of stream feeds without intermediately storing the sheets in magazines and decollating the sheets anew from the stacks.

12 Claims, 4 Drawing Sheets

METHOD AND DEVICE FOR GATHERING SHEETS

BACKGROUND OF THE INVENTION

The invention pertains to a method and a device for gathering printed sheets, particularly signatures and/or individual sheets.

During the gathering process in a book binding system, an individual signature is respectively withdrawn from several collections of identical signatures, wherein the various decollated signatures are delivered to a collecting conveyor in order to form stacks.

Known gathering machines feature feeder stations that are arranged in a row and respectively consist of a magazine for accommodating a signature stack, a withdrawal drum with a gripper mechanism for taking hold of and withdrawing the respective bottom signature that is tilted away from the signature stack, and an intermediate support for temporarily depositing the decollated signature. The collecting conveyor features a collecting channel that is oriented perpendicular to the signature withdrawal direction, wherein pushers of a transport chain moving in said collecting channel strip the decollated signatures off the individual intermediate supports and gather the signatures into a book block on the collecting channel.

Such a gathering machine that operates with a change of direction is described in DE 14 86 744 B. This machine furthermore features reciprocating intermediate tables for pre-accelerating the decollated signatures for the transport by the pushers of the collecting conveyor. Acceleration systems require further costly structural measures and also impair the functional reliability.

A gathering machine with feed stations according to the longitudinal withdrawal principle is known from DE 196 16 047 A1, wherein this gathering machine comprises a conveyor belt that carries a signature stack in a magazine such that a region of the folded edge remains exposed and respectively advances the bottom signature in a correspondingly cyclic fashion, as well as a withdrawal conveyor system that serves for receiving and additionally transporting the advanced signatures and is composed of acceleration rollers. A clamping conveyor consisting of an upper and a lower conveyor belt is arranged downstream of the withdrawal conveyor system and inclined toward the collecting conveyor, wherein this clamping conveyor deposits the decollated signatures on the stack being formed with a synchronous transport movement upstream of a pusher of the collecting conveyor. The signatures decollated by the feeder stations are delivered to the collecting conveyor without a change of direction.

Withdrawal systems operating in accordance with the longitudinal withdrawal principle are suitable for higher capacity ranges. However, since this frequently requires a labor-intensive replenishing of signatures in the magazines, bundle feeders that create a stream feed from the signatures stacked into (sheet) bundles are increasingly utilized for filling the magazines, wherein the signatures are quasi decollated. The stream feed is deposited in the form of a stack once again when the magazines are filled such that the signatures are decollated anew in the feeder stations. There also exist signature rolls with signatures that are wound up in a coil in a shingled arrangement. The stream feeds are unwound in unrolling stations and transferred into the magazines of the gathering machine. The regular arrangement of the signatures in the stream feed is lost when the magazines are filled such that the complex decollating process described above needs to be carried out.

US 2005 077 670 A1 describes a feeder station that consists of a bundle feeder and a transfer device, wherein the signatures decollated from the (sheet) bundle in the form of a stream feed are placed into a horizontal buffer station realized similar to a magazine in a waterfall-like fashion, and wherein the signatures are then withdrawn from the buffer station again in order to be perpendicularly delivered to the collecting conveyor by the transfer device. The thusly decollated signatures are ultimately deflected with a transfer device and delivered to the collecting conveyor. The signatures consequently are decollated twice in this case.

Decollating processes on stack magazines represent functionally critical process steps, particularly if a subsequent decollating process can only be initiated once the preceding signature is completely withdrawn from the magazine as is the case with the aforementioned feeder stations with transverse and longitudinal sheet withdrawal. Due to the parallel arrangement of several feeder stations on a gathering machine, a few malfunctions of individual feeder stations can already result in a substantial reduction of the net gathering capacity.

DE 33 15 489 A1 describes a method, in which a stream feed is divided into partial streams of signatures that are uniformly spaced apart from one another, wherein the partial streams are delivered to decollating devices, e.g., gripper drums, without magazining the signatures. The leading edges of the signatures lie on top of one another toward the front and need to reach the gripper drum synchronous with the gripping cycle. Another disadvantage can be seen in that the signatures are delivered into the collecting channel transverse to the collecting transport direction by the gripper drum such that a change of direction with correspondingly jerky transport movements takes place.

SUMMARY OF THE INVENTION

The present invention is based on the objective of developing a method and a device for gathering printed sheets, particularly signatures and/or individual sheets, which allow the reliable and careful processing of sheets supplied in the form of stream feeds without intermediately storing the sheets in magazines and therefore without decollating the sheets from stacks.

The sheets supplied in the form of a stream feed are delivered to the collecting conveyor in order to form stacks without intermediate magazining. The respective front sheet of the stream feed supplied transverse to the transport direction of the collecting conveyor is taken hold of such that it is prevented from turning and transferred to a withdrawal conveyor system for the additional transfer to the collecting conveyor by displacing the sheet in the collecting transport direction. The stream feed is quasi pulled apart in the transport direction of the collecting conveyor such that individual sheets are synchronously delivered to the collecting conveyor in the corresponding cycle. While the displaced front sheet is withdrawn, the ensuing sheet is already transported into the deflection conveyor, wherein a relatively large time window is available for the ensuing sheet in order to reach the deflecting position for the displacement in the corresponding cycle. Therefore, sheets that are irregularly arranged in the stream feed can also be reliably processed to a certain extent. Complicated decollating devices as they can be found in conventional feeder stations for gathering machines are not required. The invention is based on the notion that stream feeds are also supplied in the form of sheets that are completely separated from one another, i.e., sheets that also do not lie on top of one another in a partially identical fashion, wherein this is the case, for example, in the technique of wound-up stream feeds that are rotationally withdrawn.

It proved advantageous to supply the sheets in the stream feed such that they lie on top of one another toward the front in a shingled fashion. The respective front sheet lies on the ensuing sheet, i.e., it is withdrawn from the top and does not have to be pulled out of the coherent stream feed. According to one preferred additional development, the arriving stream feed of sheets is pulled apart in several accelerations stages, namely by initially displacing the respective front sheet such that it is deflected in the transport direction of the collecting conveyor with a slower transport speed and then additionally transported by the withdrawal conveyor system with a higher transport speed. This makes it possible to minimize the occurring accelerations such that a careful transport is achieved. The transport speed of the withdrawal conveyor system is preferably slower than the transport speed of the collecting conveyor such that the stream feed is pulled apart in three acceleration stages, wherein the third acceleration stage takes place during the transfer of the sheets to the collecting conveyor.

BRIEF DESCRIPTION OF THE DRAWING

Characteristics of the present invention are described in greater detail below with reference to preferred embodiments of the invention that are illustrated in the enclosed figures. The individual figures show.

DESCRIPTION OF THE PREFERRED EMBODIMENTS

Figure 1:
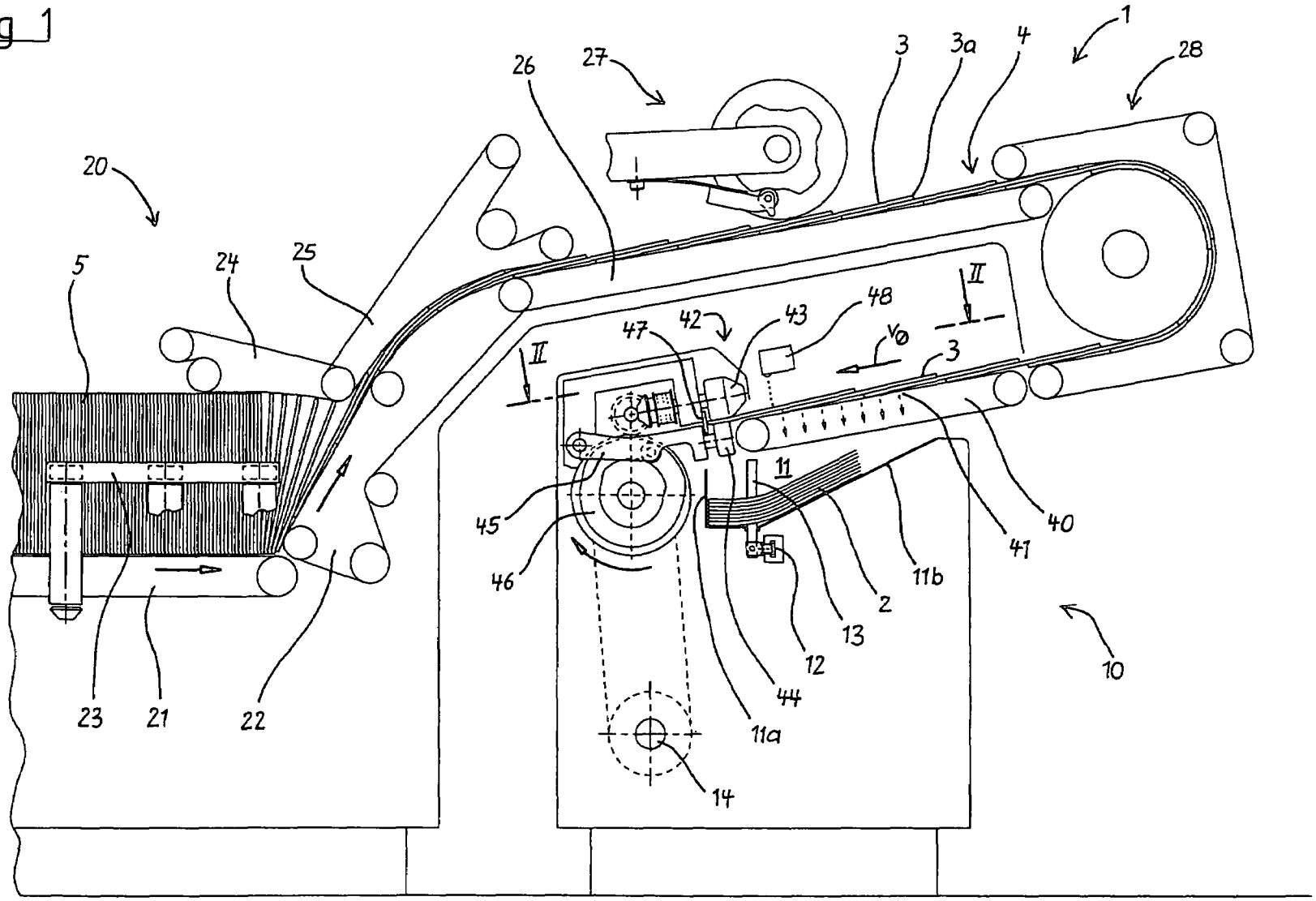
FIG. 1, a schematic sectional representation of a gathering machine with an upstream bundle feeder for signature bundles.

The gathering machine 1 has a plurality of feeder stations that are arranged in a row, wherein only a single feeder station realized in accordance with the invention is respectively illustrated in the figures. One individual signature 3 is respectively withdrawn from a collection of identical signatures in each of these feeder stations and delivered to a collecting conveyor 10 of the gathering machine 1 in order to form stacks. The collecting conveyor 10 is formed by a transport channel 11 with a vertical channel wall 11*a* and an inclined channel bottom 11*b*, as well as a transport chain 12 with pushers 13 that are uniformly spaced apart from one another and advance the book blocks 2 being formed in the transport channel 11.

In the first embodiment that is illustrated in FIG. 1, the signatures 3 are made available in the form of signature bundles 5, wherein a bundle feeder 20 forms a stream feed 4 from the signatures bundles 5. In order to form a stream feed of signatures 3 from a signature bundle 5, the signature bundle is pushed against a separating conveyor 22 that extends obliquely upward while it lies on a conveyor belt 21, wherein the transport speed of the separating conveyor is higher than the advancing speed of the conveyor belt 21. This results in the formation of a stream feed 4 with signatures 3 that lie on top of one another toward the rear in a shingled fashion. The gutterstick 3*a* of the signatures 3 points forward in this case.

In order to loosen up the signatures 3 in the signature bundle 5, lateral chain conveyors 23 are provided that constrict the transport width relative to one another approximately in the center of their transport path such that the signatures 3 bulge therebetween. In the front region of the conveyor belt 21, an upper belt 24 that transports the signatures 3 forward against the oblique separating conveyor 22 is arranged above the signatures 3. A synchronously driven upper belt 25 is also assigned to the separating conveyor 22 in the first transport section and directed obliquely upward in order to safely transport away the signatures 3.

The additional transport is realized with a conveyor belt 26, wherein a standardizing device 27 is provided that displaces the signatures 3 of the stream feed such that they are mutually spaced apart by the same distances. The conveyor belt 26 is followed by a turning drum 28 that changes the stream feed 4 into a formation, in which the signatures 3 lie on top of one another toward the front in a shingled fashion and the gutterstick 3*a* points forward.

Figure 2:
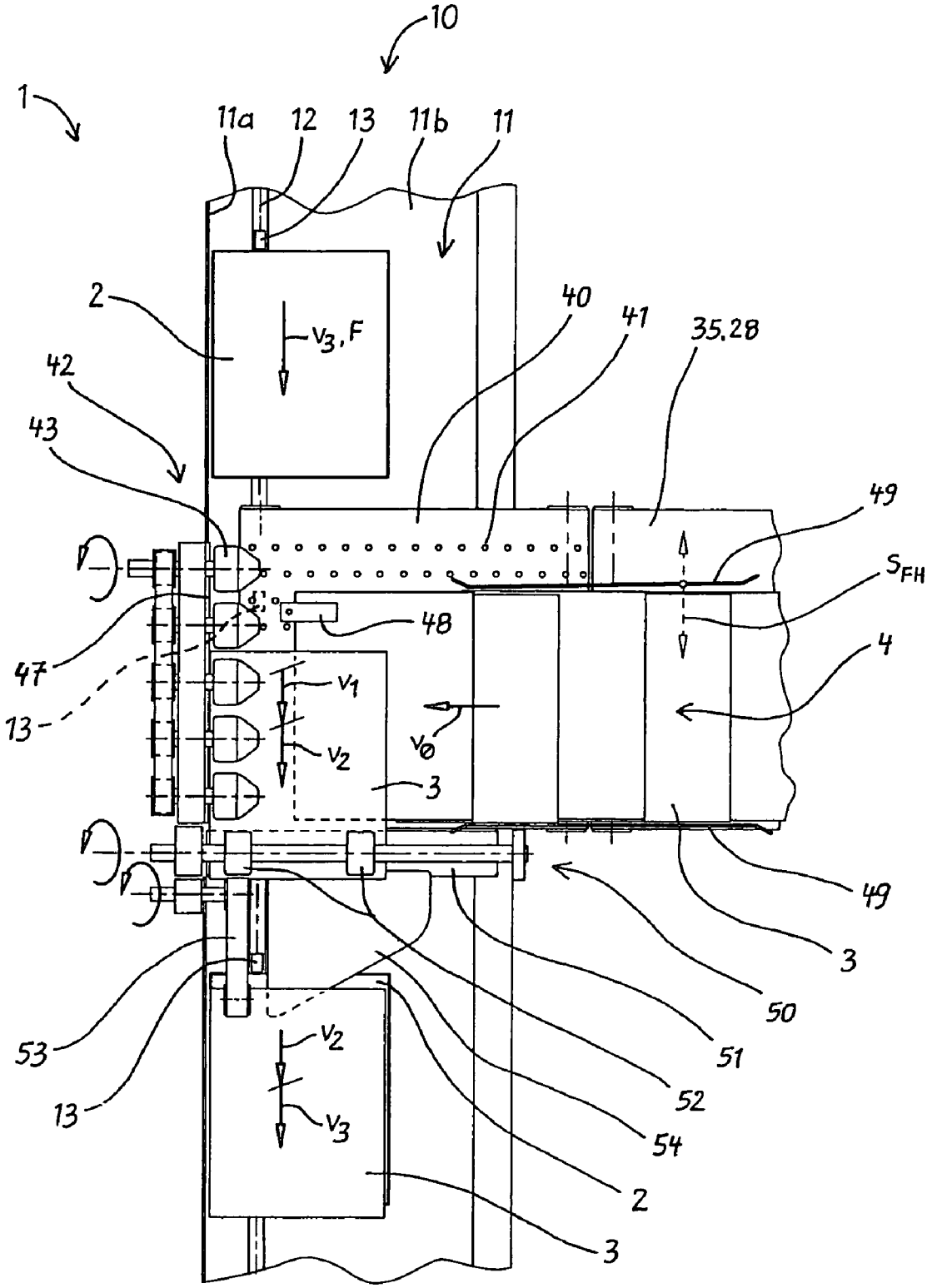
FIG. 2, a top view along the line of section II-II in FIG. 1.

The thusly formed stream feed 4 is then delivered to the collecting conveyor 10 transverse to the collecting transport direction F with the transport speed $v_0$ by a delivery conveyor 40 that is realized in the form of a conveyor belt with descending incline, wherein a lateral alignment is realized with the aid of guide rails 49. The left side referred to the transport direction is stationary while the right guide rail 49 is adjustable with respect to the format height of the signatures 3 as symbolized with a double arrow $S_{FH}$ drawn with broken lines in FIG. 2.

The respective front signature 3 contacts a stop rail 47 with its gutterstick 3*a* that points forward while the ensuing signatures 3 lying thereunder are additionally transported. The conveyor belt of the delivery conveyor 40 features openings 41 that can be acted upon with suction air in order to hold and additionally transport ensuing signatures 3 on the delivery conveyor 40 in their shingled arrangement while the front signature 3 is braced on the stop rail 47.

According to the invention, the front signature 3 is taken hold of by a deflection conveyor 42 and moved in the collecting transport direction F. The deflection conveyor 42 is formed by driven upper transport rollers 43 that have a conical face and assigned lower inching rollers 44 that can be closed and opened in the corresponding cycle, wherein the signature 3 is clamped at its leading section. The clamping width extends over nearly the entire height of the signature 3 such that it is prevented from turning during the transport by the deflection conveyor. The inching rollers 44 are arranged on a lever that is controlled by a cam plate 46 that, in turn, is driven synchronous with the cycle of the gathering machine 1 by a main drive shaft 14.

The deflection conveyor 42 transports the front signature 3 to the withdrawal conveyor system 50 with a slow transport speed $v_1$, wherein the withdrawal conveyor system is formed by a continuously driven acceleration roller 51 and assigned pressing rollers 52. The withdrawal conveyor system 50 receives the signatures 3 with a higher transport speed $v_2$ and withdraws the signatures 3 from the stream feed 4. The inching rollers 44 of the deflection conveyor 42 are pivoted downward in this case and not only allow the accelerated withdrawal of the displaced signature 3, but also the infeed of the next following signature 3 into the deflection conveyor 42.

A clamping belt conveyor 53 with assigned supporting plate 54 is arranged downstream of the withdrawal conveyor system 50 and inclined toward the collecting conveyor 10, wherein the clamping belt conveyor transports the signature 3 in front of the respective pusher 13 of the collecting conveyor 10 with the same transport speed $v_2$. In this case, the transport speed $v_2$ is slower than the transport speed $v_3$ such that another increase in the transport speed takes place during the transfer to the pusher 13.

The front signature 3 therefore is accelerated to the transport speed $v_3$ of the collecting conveyor 10 in three acceleration stages $0 \rightarrow v_1$, $v_1 \rightarrow v_2$ and $v_2 \rightarrow v_3$ such that the front signature 3 is reliably and carefully decollated from the stream feed 4 and delivered to the collecting conveyor 10 in order to form stacks. In this case, preferred transport speeds are $v_1=0.25*v_3$ and $v_2=0.8*v_3$.

In order to monitor and control the withdrawal of the signatures 3 from the stream feed 4, a light barrier 48 is provided above the delivery conveyor. Its distance from the stop rail 47 is slightly shorter than the shingle spacing of the signatures 3 such that the light barrier is briefly uncovered during each withdrawal of the respective front signature 3. The detection of the leading edge of the ensuing signature 3 quasi determines the position of the stream feed 4 relative to the cycle of the collecting conveyor 10 or the deflection conveyor 42 that can be opened and closed, respectively. A control unit that is not illustrated in detail synchronizes the delivered stream feed 4 relative to the collecting conveyor 10 by increasing or decreasing the delivery speed $v_0$ accordingly.

Figure 3:
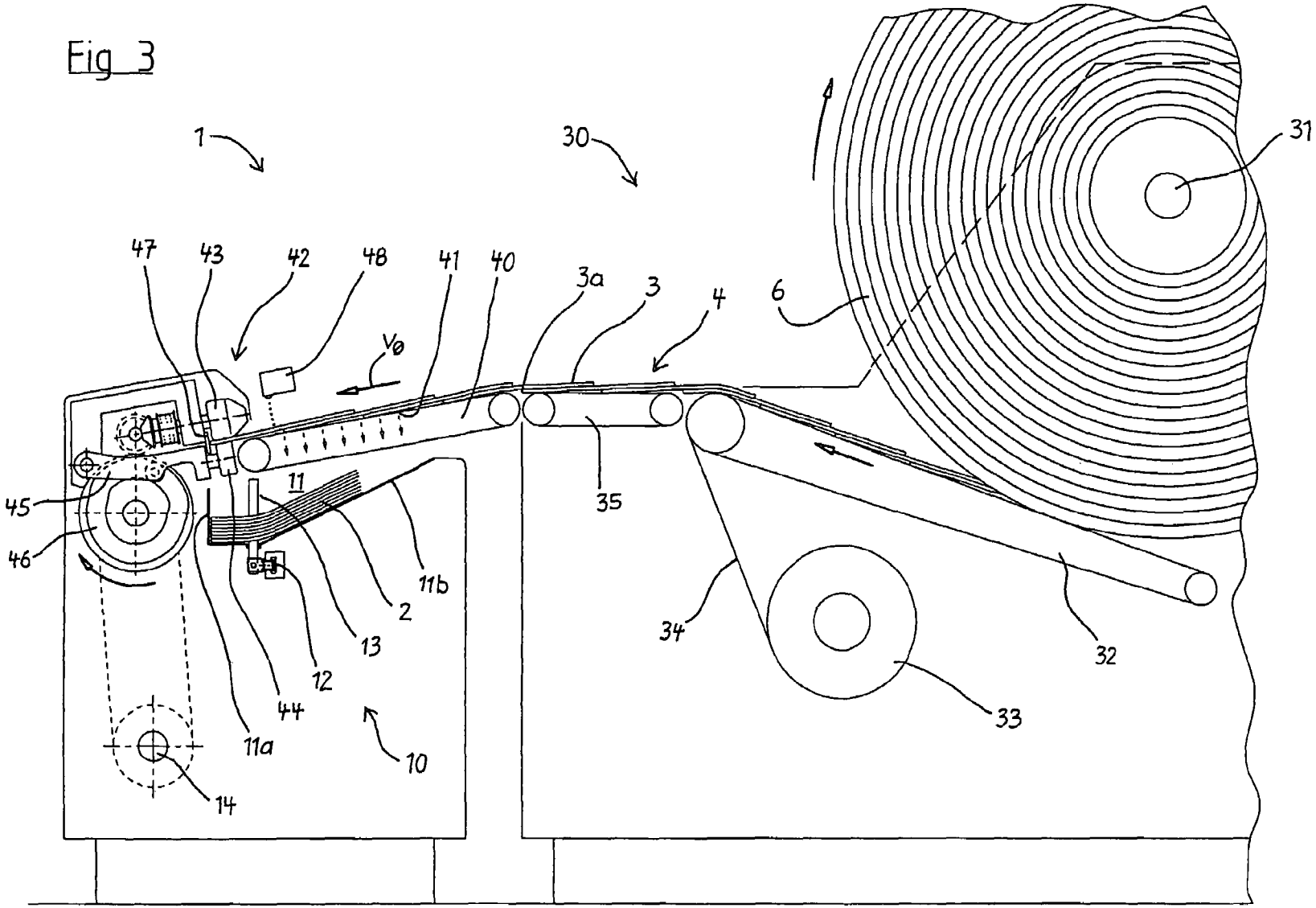
FIG. 3, a schematic section through a gathering machine with an upstream unrolling station for signature rolls, and FIG. 4, a schematic section through an alternative embodiment of the stream feed to the collecting channel of the gathering machine.

In a second embodiment that is illustrated in FIG. 3, the signatures 3 are made available on signature rolls 6. The signatures 3 are wound up such that they lie on top of one another in a shingled fashion and fixed with a band 34 that is wound up with the signatures. The respective signature roll 6 is unwound while received on an arbor 31 in an unrolling station 30, wherein a conveyor belt 32 placed against the circumference of the signature roll 32 receives and transfers the stream feed 4 to said delivery conveyor 40 with the aid of another conveyor belt 35. The band 34 is deflected away from the stream feed 4 and wound up on a roll 33.

In this embodiment, the signatures 3 of the stream feed 4 unwound from the signature roll 6 lie on top of one another toward the front such that their gutterstick 3*a* points forward and the stream feed 4 does not have to be turned, for example, with the aid of a turning drum. The arrangement of the signatures 3 in the stream feed 4 is highly uniform because it was conventionally formed during the withdrawal of the signatures 3 from a rotary printing press. Signature rolls 6 are also particularly suitable for the method according to the invention.

Figure 4:
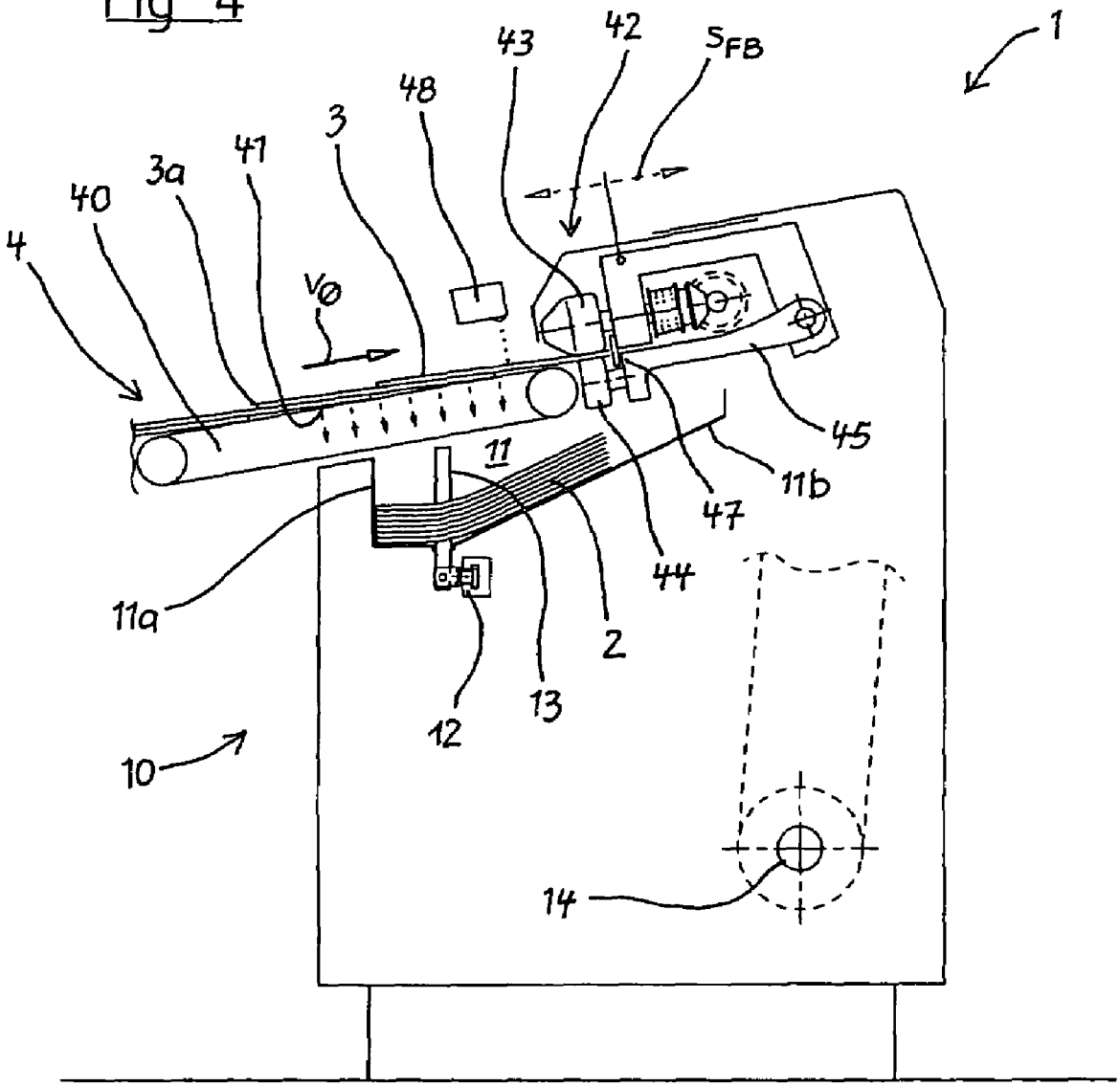

FIG. 4 shows an alternative embodiment of the stream feed to the collecting channel 11 of the gathering machine 1. This embodiment is suitable for processing a stream feed 4 with signatures 3 that lie on top of one another toward the front such that their gutterstick 3 a points rearward. The device is essentially realized in the form of a mirror image of the delivery conveyor 40 and has an ascending incline in order to counteract the incline of the collecting channel 11. The deflection conveyor 42 takes hold of the leading open edge of the signature 3 and displaces the signature 3 in the transport direction F of the collecting conveyor 10 in order to transfer the signature 3 to the withdrawal conveyor system.

The deflection conveyor 42 with the stop rail 47 as well as the delivery conveyor 40 can be adjusted with respect to the format width of the signature 3 transverse to the transport direction F of the collecting conveyor 10 as symbolized with the double arrow $S_{FB}$ drawn with broken lines in FIG. 4 such that the signature 3 with its gutterstick 3*a* can always be transferred to the collecting conveyor 10 near the stationary vertical channel wall 11*a* of the collecting channel 11.

The invention claimed is:

1. In a method for gathering a plurality of different printed sheets from a respective plurality of collections, each collection having respective identical sheets taken from one of a respective plurality of feeder stations, wherein one individual sheet is respectively withdrawn cyclically from each collection of identical sheets and the withdrawn sheets are delivered to a common collecting conveyor moving continuously in a transport direction, in order to form stacks of different sheets on the collecting conveyor, the improvement comprising that:

the sheets of a collection are transported in a direction that is oriented transverse to the transport direction (F) of the collecting conveyor, in the form of a continuous stream feed of sheets that lie on top of one another in a shingled fashion;

a front portion of the respective front sheet of the shingled sheets is taken hold of by a deflection conveyor such that the held sheet is prevented from turning and it is displaced such that it is deflected in the transport direction (F) of the collecting conveyor;

the displaced sheet is received by a withdrawal conveyor system and additionally transported in said transport direction (F) in order to synchronously deliver the sheets onto the stack on the moving collecting conveyor during each cycle;

wherein the sheets are delivered to the collecting conveyor in the form of a stream feed of sheets that lie on top of one another toward said front portion, in a shingled fashion;

wherein the arriving stream feed of sheets is pulled apart in several acceleration stages ($0 \rightarrow v_1$, $v_1 \rightarrow v_2$) by initially displacing the respective front sheet in the transport direction (F) of the collecting conveyor with a slower transport speed ($v_1$) and then additionally transporting this front sheet with a higher transport speed ($v_2$) by the withdrawal conveyor system; and including another acceleration stage ($v_2 \rightarrow v_3$) during the transfer of the sheet to the collecting conveyor wherein the transport speed ($v_2$) of the withdrawal conveyor system is slower than the transport speed ($v_3$) of the collecting conveyor.

2. A device for gathering and stacking different printed sheets having a format height and width, comprising:

several feed devices that are arranged in a row for respectively providing different sheets from respective sources of identical sheets;

a collecting conveyor moving continuously in a transport direction (F), to which different individual sheets are delivered in sequence in order to form stacks of different sheets on the collecting conveyor;

a delivery conveyor for each feed device that is approximately oriented perpendicular to the transport direction (F) of the collecting conveyor and transports the sheets to the collecting conveyor in the form of a continuous stream feed of sheets that lie on top of one another in a shingled fashion, whereby the shingled feed stream has a front sheet closest to the collecting conveyor;

a deflection conveyor for each delivery conveyor that clamps the front sheet on a front portion and displaces this front sheet in the transport direction (F) of the collecting conveyor, with a clamp having a width that is larger than half the format height of the sheets;

a withdrawal conveyor system for each deflection conveyor that receives and additionally transports the displaced sheet onto a stack on the collecting conveyor in an accelerated fashion;

wherein each feed device includes a bundle feeder that is arranged upstream of the delivery conveyor and forms a stream feed from sheets that are stacked in bundles;

the deflection conveyor comprises driven upper transport rollers that have a conical face and operatively associated lower inching rollers that are cyclically closed and opened; and the withdrawal conveyor engages the front sheet while partially shingled and completely withdraws the engaged sheet from the shingled stream feed.

3. The device according to claim 2, wherein the delivery conveyor is formed by a conveyor belt that extends as far as the deflection conveyor, and the stream feed of sheets that lie on top of one another toward the front in a shingled fashion is situated on said conveyor belt.

4. The device according to claim 3, wherein the conveyor belt has openings that are operatively associated with a source of suction air to hold the sheet that follows the displaced front sheet.

5. The device according to claim 2, including a turning drum arranged downstream of the bundle feeder.

6. The device according to claim 2, including a device for standardizing the shingled formation, operatively associated with the delivery conveyor.

7. The device according to claim 2, including a stop rail on the downstream end of the delivery conveyor to stop the front sheet of the stream feed.

8. The device according to claim 2, wherein the withdrawal conveyor system comprises an acceleration roller with at least two pressing rollers that are spaced apart by a distance that is larger than half the format width of the sheets.

9. The device according to claim 2, including a transport device arranged downstream of the withdrawal conveyor system, comprising a lower and an upper conveyor belt that clamp the sheet and a supporting plate, wherein said transport device is inclined toward the collecting conveyor.

10. The device according to claim 2, comprising a slower transport speed ($v_1$) of the deflection conveyor and a higher transport speed ($v_2$) of the withdrawal conveyor system to increase the transport speed of the front sheet of the stream feed to be decollated.

11. The device according to claim 10, wherein the transport speed ($v_2$) of the withdrawal conveyor system is slower than the transport speed ($v_3$) of the collecting conveyor, and the delivered sheet is subjected to a final acceleration during the transfer to the collecting conveyor.

12. The device according to claim 2, including a light barrier arranged on the downstream end of the delivery conveyor to detect the leading edge of the respective front sheet, wherein a controller responsive to a signal from said light barrier automatically regulates the delivery speed ($v_0$) of the delivery conveyor in such a way that the respective front sheet reaches said clamps during a defined time window of a machine cycle.

* * * * *